US006742418B2

(12) United States Patent
Amami

(10) Patent No.: US 6,742,418 B2
(45) Date of Patent: Jun. 1, 2004

(54) TORQUE WRENCH

(75) Inventor: Tatsuya Amami, Habikino (JP)

(73) Assignee: Kuken Co., Ltd., Osaka (JP)

( * ) Notice: Subject to any disclaimer, the term of this patent is extended or adjusted under 35 U.S.C. 154(b) by 23 days.

(21) Appl. No.: 10/282,061

(22) Filed: Oct. 29, 2002

(65) Prior Publication Data

US 2003/0079569 A1 May 1, 2003

(30) Foreign Application Priority Data

Oct. 29, 2001 (JP) ..... 2001-330301

(51) Int. Cl.[7] ..... B25B 13/46; B25B 23/159
(52) U.S. Cl. ..... 81/57.39; 81/478; 81/59.1
(58) Field of Search ..... 81/57.39, 473–476, 81/478, 480–483, 59.1; 192/44

(56) References Cited

U.S. PATENT DOCUMENTS 5,237,885 A * 8/1993 Putney et al. ..... 81/57.39
6,112,624 A * 9/2000 Chen ..... 81/59.1
6,298,753 B1 * 10/2001 Izumisawa ..... 81/57.39

* cited by examiner

*Primary Examiner*—D. S. Meislin
(74) *Attorney, Agent, or Firm*—Wenderoth, Lind & Ponack, L.L.P.

(57) ABSTRACT

A torque wrench is formed by a hollow handle, a sheath tube, a head, a slider, a torque transmitting mechanism, a torque adjusting mechanism, etc. The sheath tube covers the front half of the hollow handle with a predetermined gap between the inner and outer surfaces of the sheath tube and the hollow handle, respectively, and is connected to the front of the hollow handle and also to the head at the front thereof. The slider is moveably disposed around the hollow handle in the longitudinal direction of the hollow handle such that the front end surface of the slider opposes the rear end surface of the sheath tube. The torque transmitting mechanism is disposed between the opposing end surfaces of the slider and the sheath tube, and the torque adjusting mechanism is disposed in the rear of the slider and around the rear half of the hollow handle.

5 Claims, 7 Drawing Sheets

TORQUE WRENCH

BACKGROUND OF THE INVENTION

1. Field of the Invention

The present invention relates to an improved torque wrench for fastening or unfastening screws such as a bolt or a nut.

2. Description of the Related Art

A widely used hand wrench has a handle, a ratchet mechanism housed in the head of the handle, and an output shaft rotatably disposed at the head. By turning the handle clockwise and counterclockwise in a reciprocating manner, the ratchet mechanism allows the output shaft to rotate in one direction and thus a socket attached to the output shaft to fasten or unfasten a screw.

In order to construct a torque wrench utilizing such a hand wrench, the handle is formed of a sheath tube 31, as shown in FIG. 9.

The sheath tube 31 is pivotally attached to the base of a head 32 at the front thereof. The sheath tube 31 has a pestle 33 extending backwards from the head 32 inserted thereinto. Also, the sheath tube 31 has a slider 34 disposed in the central part thereof. The slider 34 and the pestle 33 oppose each other at the slanted opposing surfaces thereof and are connected by a link toggle 35 disposed orthogonal to these opposing surfaces.

In addition, the sheath tube 31 has a torque adjusting screw 36 and a nut 37, which is screwed together with the torque adjusting screw 36, disposed in the rear part thereof. Furthermore, the sheath tube 31 has a coil spring 38 placed between the nut 37 and the slider 34.

The head 32 has an output shaft 39 rotatably disposed in the center thereof.

In order to fasten a screw by using the torque wrench having the above-described structure, the sheath tube 31 is turned clockwise and counterclockwise in a reciprocating manner.

With this arrangement, by turning the output shaft 39 via the ratchet mechanism in its fastening direction, the torque wrench fastens a screw inserted in a socket attached to the output shaft 39.

After the screw is placed at the predetermined position thereof, and when the fastening torque reaches a predetermined value by further turning the sheath tube 31 clockwise and counterclockwise, the link toggle 35 is activated and then the pestle 33 and the slider 34 hit against each other at the opposing surfaces thereof. A hitting sound caused by the above hitting or a turning lash of the sheath tube 31 allows an operator to determine if the torque wrench reaches a predetermined fastening torque of the screw.

A power torque wrench in which a motor for transmitting a rotating torque to the output shaft 39 is incorporated into the foregoing structure of the hand torque wrench is considered. However, when the motor is disposed in the rear part of the sheath tube 31, the pestle 33 extending from the head 32, the slider 34, and so forth disposed in the central part of the sheath tube 31 hinder the power torque wrench to have a structure in which the torque of the motor is transmitted to the output shaft 39.

To solve this problem, as disclosed in Japanese Patent Application Publication No. 8-112775 and also as shown in FIG. 10, another power torque wrench is constructed such that the sheath tube 31 has a motor 40 disposed above the front half thereof so that the torque of the motor 40 is transmitted to the output shaft 39.

With this structure, in the fastening operation of this torque wrench, the motor 40 rotates the output shaft 39 at high speed so as to place a screw at the predetermined position thereof. After the screw is placed, the sheath tube 31 is turned by hand up to a predetermined fastening torque in a similar fashion to that of the hand torque wrench.

In the foregoing power torque wrench, the motor 40 is additionally attached above the sheath tube 31. Accordingly, the enlarged height of the whole torque wrench not only makes the handling of the torque wrench difficult but also may cause a problem in that, when a working space is tight or there is an obstruction around an object to be fastened, the motor 40 hinders an operator to perform his or her fastening work. Also, the torque wrench becomes unstable because of the center of gravity of the torque wrench is shifted upwards by the motor 40, thereby resulting in the poor operationality thereof.

SUMMARY OF THE INVENTION

In view of the above problems, the present invention has been made. Accordingly, it is an object of the present invention to provide a torque wrench which has a motor, which is housed therein but not additionally attached thereon, so as to make the whole size thereof compact, achieves improved handling and operationality, smoothly transmits the torque of the motor to an output shaft, and also allows an operator to fasten a screw with a predetermined fastening torque by hand.

A torque wrench according to the present invention comprises a motor; an output shaft; a straight hollow handle comprising a grip, housing the motor therein, integrally formed therewith at the rear thereof; a head disposed at the front of the hollow handle and rotatably supporting the output shaft in the vertical direction so as to be orthogonal to the longitudinal direction of the hollow handle; a transmission shaft disposed in the hollow handle; a rotation-direction changeover mechanism which transmits the rotation of the motor to the output shaft via the transmission shaft; a sheath tube which covers the front half of the hollow handle with a predetermined gap between the inner surface of the sheath tube and the outer surface of the hollow handle, and which is connected to the head at the front thereof and to the front of the hollow handle; a slider moveably disposed around the hollow handle in the longitudinal direction of the hollow handle such that the front end surface of the slider opposes the rear end surface of the sheath tube; a torque transmitting mechanism disposed between the mutually opposing end surfaces of the slider and the sheath tube; and a torque adjusting mechanism disposed in the rear of the slider and around the rear half of the hollow handle.

With this structure, although the hollow handle is formed so as to be independent from the head rotatably supporting the output shaft, the torque of the motor housed in the grip at the end of the hollow handle is reliably transmitted to the output shaft via the transmission shaft in the hollow handle, and also a screw can be fasted by hand.

Accordingly, since the whole structure of the torque wrench becomes compact, the torque wrench can be easily handled and stably operated so that a screw is smoothly fastened even when a working space is tight or there is an obstruction around the screw.

In addition, by rotating the motor when the rotation-direction changeover mechanism is changed over to a fastening mode of a screw, the output shaft is quickly rotated only in the fastening direction of the screw so that the screw is quickly fastened to the seating surface thereof.

When the screw is seated on the seating surface, by turning the hollow handle by hand clockwise and counterclockwise in a reciprocating manner, the torque of the manual turning operation is transmitted to the sheath tube via the torque transmitting mechanism. Then, the sheath tube turns about the output shaft in a reciprocating manner so that the screw is further fastened via the rotation-direction changeover mechanism only when the sheath tube turns outwards.

Furthermore, when the frictional force between the screw and the seating surface reaches a value corresponding to the predetermined fastening torque set by the torque adjusting mechanism, the torque transmitting mechanism is activated so as to reliably determine that the screw has been fastened with the predetermined fastening torque.

In the torque wrench according to the present invention, the rotation-direction changeover mechanism is preferably characterized in that the head has a center hole vertically extending therethrough, the output shaft is formed as a regular polygonal column extending in the vertical direction and having side surfaces, and rotatably disposed in the center hole of the head, a space is formed between each side surface of the output shaft and the inner wall of the center hole, and divided into a pair of wedge-shape spaces, each becoming narrower from the center to the corresponding edge of the side surface, a cylindrical locking member is disposed in the middle of the space so as to engage into either one of the wedge-shape spaces on both sides thereof, and a changeover member, which pushes the locking member toward either one of the wedge-shape spaces on both sides thereof, is disposed in a space between the adjacent cylindrical locking members so as to be moveable for changeover in the circumferential direction of the output shaft.

With this structure, by turning the head about the output shaft in the fastening direction of the screw, the locking members engage into the corresponding wedge-shape spaces ahead of the fastening direction, whereby the turning torque of the head is reliably transmitted to the output shaft.

Also, when the head is turned in the unfastening direction of the screw, the locking members disengage from the corresponding wedge-shape spaces and are received by the corresponding changeover pieces within the moveable regions of the corresponding spaces. Accordingly, the screw can be fastened by transmitting the fastening torque of the head to the output shaft only when the head is turned in the fastening direction of the screw by a predetermined angle.

In the torque wrench according to the present invention, the torque transmitting mechanism may comprise a pair of first projections disposed at the upper and lower parts of the rear periphery of the sheath tube and having slanted engaging surfaces protruding toward the rear direction.

In addition, the torque transmitting mechanism may comprise a pair of second projections disposed at the upper and lower parts of the front periphery of the slider and disengageably engaging the corresponding slanted engaging surfaces of the first projections.

With the structure, when the hollow handle is turned to fasten the screw by hand, since the first and second projections are engaged with each other, the turning torque of the manual operation is reliably transmitted to the sheath tube so as turn the output shaft.

When the fastening torque of the screw reaches a predetermined value, since the second projections close to the hollow handle move in the fastening direction of the screw relative to the corresponding first projections close to the sheath tube, the fact that the screw has been fastened with the predetermined fastening torque is easily confirmed.

In the torque wrench according to the present invention, the torque adjusting mechanism may comprise an adjusting nut which is screwed together with a male-threaded portion formed on the rear half of the hollow handle and an adjusting coil spring disposed between the mutually opposing end surfaces of the adjusting nut and the slider in a compressed manner.

With this structure, by moving the adjusting nut disposed around the hollow handle in the back and forth direction, since the engaging force between the first and second projections can be easily varied, the fastening torque of the screw can be precisely adjusted so as to be a predetermined fastening torque.

When the motor housed in the grip of the hollow handle is turned when the grip is held and the rotation-direction changeover mechanism is changed over to the fastening mode of the screw, the rotation of the motor is transmitted to the output shaft disposed in the head via the transmission shaft disposed in the hollow handle, and the rotation of the output shaft causes the screw to turn in the fastening direction thereof.

When the screw is seated on the seating surface, since the frictional force between the screw and the seating surface increases and becomes greater than a value corresponding to the torque of the motor, the torque of the motor becomes insufficient and the screw cannot be further fastened until the fastening torque of the screw reaches a predetermined value. Accordingly, the screw is further fastened by hand so that the fastening torque of the screw reaches the predetermined value.

The manual fastening operation is performed by operating the grip so as to turn the hollow handle clockwise and counterclockwise in a reciprocating manner. By turning the hollow handle in a reciprocating manner, the sheath tube turns about the output shaft in a reciprocating manner via the torque transmitting mechanism, thereby allowing the screw to be fastened via the rotation-direction changeover mechanism when the sheath tube moves outwards.

When the frictional force between the screw and the seating surface increases to a value corresponding to the fastening torque set by the torque adjusting mechanism, the torque transmitting mechanism is activated. With this activation, an operator is informed by his or her hand holding the grip that the fastening torque of the screw has reached a predetermined value. Then, the operator stops handling the hollow handle and finishes fastening the screw by hand.

When the fastened screw is to be unfastened, the rotation-direction changeover mechanism is changed over to an unfastening mode of the screw. By turning the hollow handle counterclockwise, the unfastening turning torque of the hollow handle is transmitted to the output shaft so as to reduce the frictional force between the screw and the seating surface. Subsequently, by turning the motor housed in the grip, the rotation of the motor is transmitted to the output shaft in an unfastening-direction via the transmission shaft disposed in the hollow handle and also via the rotation-direction changeover mechanism so that the screw is quickly unfastened.

Although the above description deals with a right-hand screw, those skilled in the art will appreciate that the present invention is applicable to a left-hand screw.

DETAILED DESCRIPTION OF THE PREFERRED EMBODIMENTS

Preferred embodiments of the present invention will be described with reference to the accompanying drawings.

Figure 1:
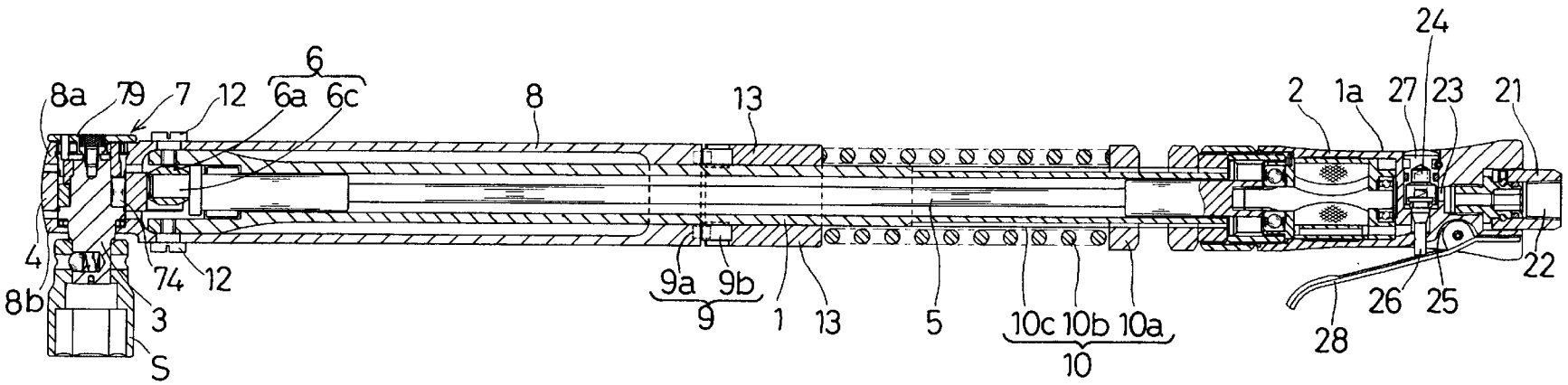
FIG. 1 is a longitudinal side view in section of a torque wrench according to an embodiment of the present invention.
Figure 2:
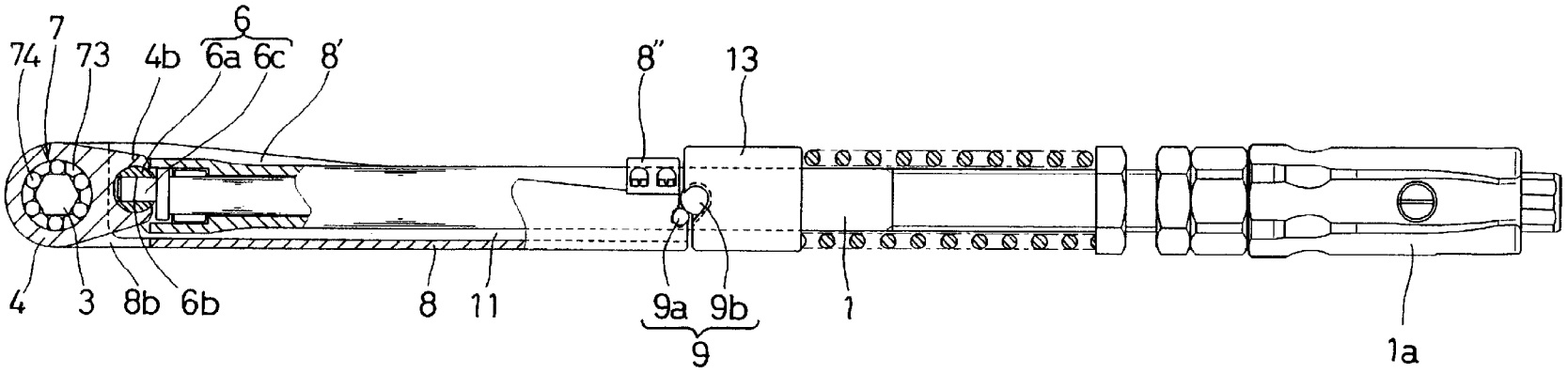
FIG. 2 is a longitudinal plan view partly in section of the torque wrench.

FIGS. 1 and 2 illustrate a torque wrench according to an embodiment of present invention.

The torque wrench is mainly formed by a straight hollow handle 1, which serves as a main body thereof and has a predetermined length, an air-motor 2, an output shaft 3, a head 4, a transmission shaft 5, a rotation transmitting mechanism 6, a rotation-direction changeover mechanism 7, a sheath tube 8, a torque transmitting mechanism 9, a torque adjusting mechanism 10, a short cylindrical slider 13, and so forth.

The hollow handle 1 has a grip 1*a*, the head 4, and the transmission shaft 5 respectively disposed at the rear, at the front, and in the central part thereof. The grip 1*a* has the air-motor 2 housed therein.

The head 4 rotatably supports the output shaft 3 in the vertical direction orthogonal to the longitudinal direction of the hollow handle 1.

The transmission shaft 5 is directly connected to the rotating shaft of the air-motor 2 at the rear end thereof and transmits the rotation of the air-motor 2 to the output shaft 3 at the front thereof via the rotation transmitting mechanism 6 and also via the rotation-direction changeover mechanism 7.

The sheath tube 8 covers the front half of the hollow handle 1 in the longitudinal direction thereof. The sheath tube 8 has upper and lower sandwiching plates 8*a* and 8*b* at the front thereof, which are bifurcated one above the other. The sandwiching plates 8*a* and 8*b* have the head 4, which is independent from the hollow handle 1, interposed therebetween so as to be rotatable clockwise and counterclockwise. Also, the sandwiching plates 8*a* and 8*b* have center holes 8*c* and 8*d*, respectively, which are coaxially in communication with a center hole 4*a* of the head 4 wherein the center hole 4*a* extends through the head 4 in the vertical direction.

The output shaft 3 has a smaller diameter than that of the center hole 4*a* and extends through the center holes 4*a*, 8*c*, and 8*d*. Also, the output shaft 3 has a large-diameter round flange 3*a* which is integrally formed therewith and which is disposed in the central part thereof with respect to the vertical direction. The round flange 3*a* is rotatably supported by the lower sandwiching plate 8*b* above the center hole 8*d* and has the holes 4*a* and 8*c* formed thereabove in which the rotation-direction changeover mechanism 7 is disposed. Also, the output shaft 3 has a square shank 3*b*, protruding downwards from the central hole 8*d*, for connecting a socket S into which a screw is fitted.

The sheath tube 8 has a gap 11 having a necessary thickness between the inner surface thereof and the outer surface of the hollow handle 1. In addition, the sheath tube 8 has a cut 8', extending along the whole length of the sheath tube 8 and having a sufficient width so as to incorporate the hollow handle 1 into the sheath tube 8, and has a cover 8" detachably attached to the rear part thereof so as to cover the rear part of the cut 8'.

The rotation transmitting mechanism 6 has a short cylindrical turning member 6*a* turnably disposed in a reciprocating manner at the rear of an arm piece 4*b* protruding backwards from the rear of the head 4. The diameters of the top and bottom of the turning member 6*a* gradually decrease upwards and downwards, respectively. Also, the rotation transmitting mechanism 6 has a crank-pin insert hole 6*b* perforated in the turning member 6*a* from the rear to front side surfaces of the same, that is, in the longitudinal direction of the transmission shaft 5, and a crank pin 6*c* protruding eccentrically from the front of the transmission shaft 5 and rotatably inserted into the crank-pin insert hole 6*b*.

With this structure of the rotation-transmitting mechanism 6, the rotation of the transmission shaft 5 causes the head 4 to turn around the output shaft 3 in a reciprocating manner in a predetermined angle range.

Alternatively, the rotation-transmitting mechanism 6 may have a bevel gear or the like so that the head 4 engages the front of the transmission shaft 5.

The air-motor 2 for rotating the transmission shaft 5 uses a compressed-air feeding attachment 21, attached to the rear of the grip 1*a* in a known manner, as a rotary drive mechanism thereof. The attachment 21 has a feeding hole 22 extending therethrough. The air-motor 2 is rotated by compressed air fed from the feeding hole 22 and flowing through a guiding path 23 disposed in the rear part of the grip 1*a*.

The guiding path 23 has a valve chamber 24 disposed halfway therethrough, and the valve chamber 24 has a valve rod 26 of a valve 25 slidabley disposed therein in the vertical direction. The guiding path 23 is normally closed since the valve 25 is constantly urged downwards by a spring 27. The valve rod 26 has a bottom end protruding out from the grip 1*a* of the hollow handle 1, and the protruding bottom end abuts against the upper surface of an operation lever 28 pivotally mounted to the grip 1*a*. Also, the guiding path 23 is opened by activating the valve 25 by turning the operation lever 28 toward the grip 1*a*.

Figure 3:
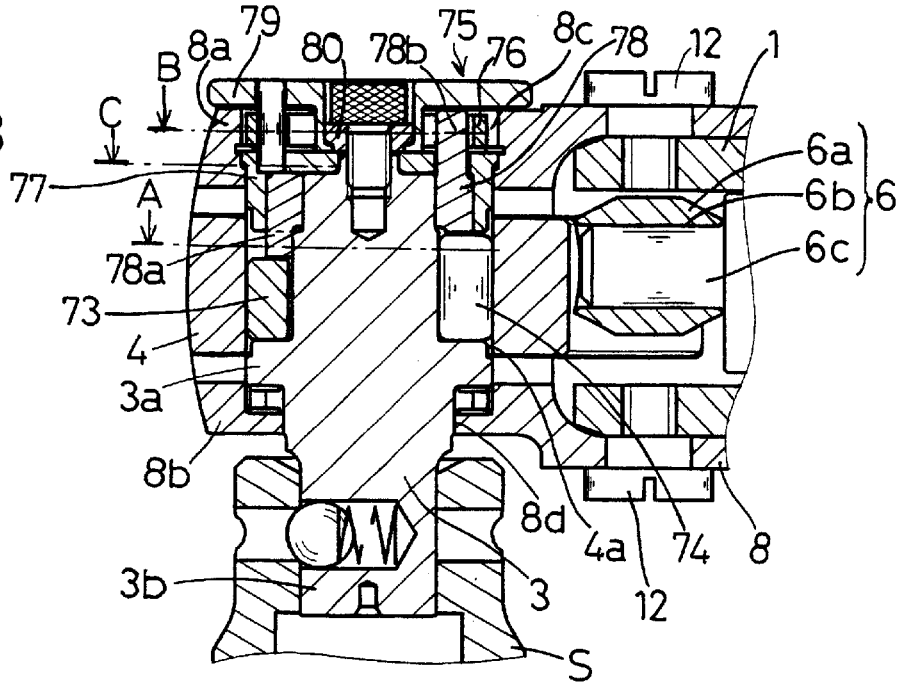
FIG. 3 is a magnified sectional side view of a head shown in FIGS. 1 and 2.
Figure 4:
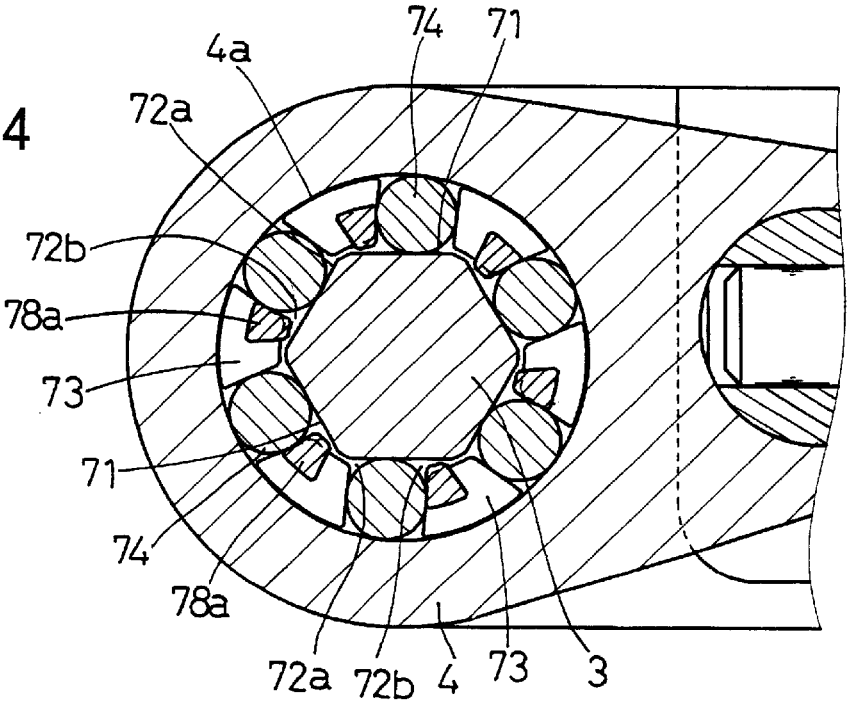
FIG. 4 is a magnified sectional plan view of the head taken along the line A—A indicated in FIG. 3.

As shown in FIGS. 3 and 4, the rotation-direction changeover mechanism 7 is formed by the output shaft 3 which is formed into a regular polygonal column (a regular hexagonal column in the figure). The rotation-direction changeover mechanism 7 is also formed by side surfaces 71 of the polygonal column, a pair of wedge-shape spaces 72*a* and 72*b*, a retainer 73 having a sectorial cross section, a long cylindrical locking member 74, all of them corresponding to each side surface 71, a changeover member 75, a changeover cam 76 having an elliptical ring shape, a stationary disk 77, a turning ring 78, and a changeover knob 79.

The polygonal column and the center hole 4*a* of the head 4 has a space between each side surface 71 of the polygonal column and the inner wall of the center hole 4*a*. Each space is formed by the wedge-shape spaces 72*a* and 72*b*, each becoming gradually narrower from the center to the corresponding edge of the side surface 71 with respect to the circumferential direction of the column.

The long cylindrical locking member 74 is moveably disposed around the column in a reciprocating manner in the central part of each space so that the locking member 74 can engage into the wedge-shape spaces 72*a* and 72*b*, and is supported by the flange 3*a* of the output shaft 3 at the bottom surface thereof. Also, the adjacent cylindrical locking members 74 have one of changeover pieces 78*a* of the changeover member 75 interposed therebetween such that the changeover piece 78*a* is moveable for change-over in the circumferential direction of the column. The changeover member 75 pushes each of the locking members 74 toward either one of the corresponding wedge-shape spaces 72*a* and 72*b* at the both sides of the locking member 74.

In addition, the adjacent cylindrical locking members 74 have the retainer 73 disposed between the lower parts thereof such that the retainer 73 keeps in contact with the opposing surfaces of the adjacent locking members 74. With this arrangement, each retainer 73 always maintains the distance between the corresponding adjacent locking members 74 constant so that all the locking members 74 and the retainers 73 can move in concert clockwise and counterclockwise around the output shaft 3.

Figure 5:
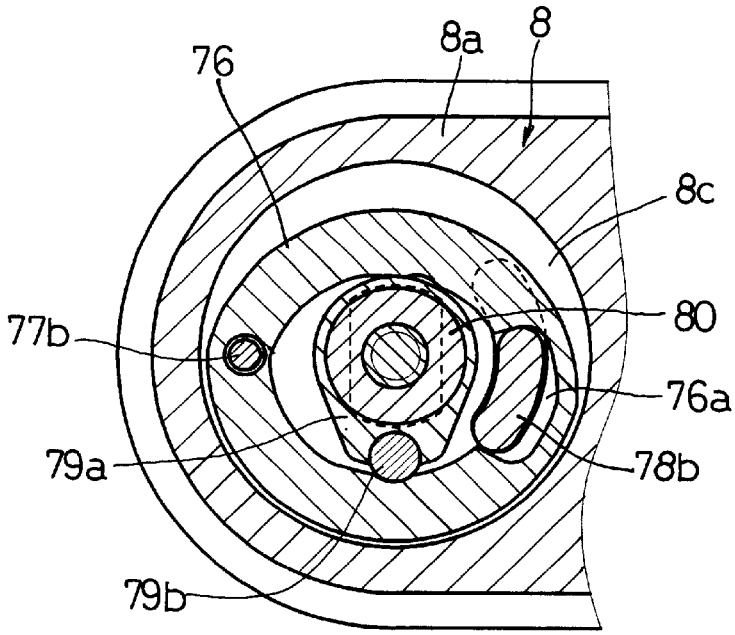
FIG. 5 is a magnified sectional plan view of the head taken along the line B—B indicated in FIG. 3.

As shown in FIGS. 3 and 5, the changeover member 75 has the changeover cam 76 disposed in the center hole 8*c* of the upper sandwiching plate 8*a*. The front end of the changeover cam 76 in the longer diameter direction is pivotally fixed to the stationary disk 77 clockwise and counterclockwise with a pivotal pin 77*b* of the stationary disk 77. The stationary disk 77 is firmly fixed to the lower circumferential surface of the upper sandwiching plate 8*a* below the center hole 8*c*.

The output shaft 3 has a cylindrical upper part inserted into the turning ring 78. The turning ring 78 has the changeover pieces 78*a*, each inserted in the space between the adjacent cylindrical locking members 74 so as to be circumferentially moveable, disposed on the bottom surfaces thereof in an evenly spaced and standing manner in the circumferential direction of the output shaft 3.

The changeover cam 76 has an engaging hole 76*a* at the rear part thereof as shown in FIG. 5.

Figure 6:
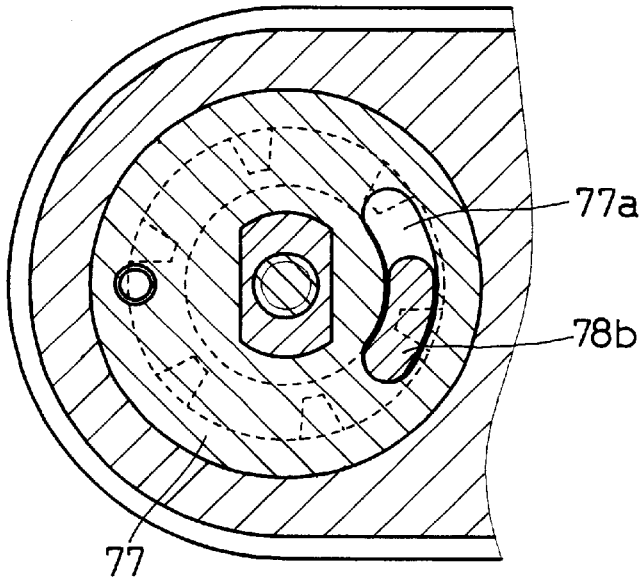
FIG. 6 is a magnified sectional plan view of the head taken along the line C—C indicated in FIG. 3.

The stationary disk 77 has an arch-shape hole 77*a* at the rear part thereof extending in the circumferential direction thereof as shown in FIG. 6.

As shown in FIGS. 3, 5, and 6, the turning ring 78 has a locking projection 78*b* disposed on the upper surface of the rear part thereof in a protruding manner such that the locking projection 78*b* extends through the arch-shape hole 77*a* so as to be moveable circumferentially, further extends through the engaging hole 76*a*, and is locked at the engaging hole 76*a*.

By turning the changeover cam 76 clockwise and counterclockwise about the pivotal pin 77*b*, the turning ring 78 is turned around the output shaft 3 so as to cause each changeover piece 78*a* to climb over the edge of the polygonal output shaft 3 and move into either one of the wedge-shape spaces 72*a* and 72*b*.

The locking member 74 in the space in which the changeover piece 78*a* has moved is received by the changeover piece 78*a* so as not to move in an opposite direction but to move in one direction toward the next wedge-shape space.

The changeover cam 76 is turned by turning the changeover knob 79 clockwise and counterclockwise, wherein the center of the knob 79 is rotatably fixed to the center of the top surface of the output shaft 3.

More particularly, as shown in FIG. 5, the changeover knob 79 has a boss 79*a*, integrally disposed at the center of the bottom surface thereof via a spacer 80, and a cylindrical rubber 79*b* fixed to the top of a projection protruding from the boss 79*a*.

In accordance with the turning operation of the changeover knob 79, the changeover cam 76 is turned by making the cylindrical rubber 79*b* slidably contact the inner surface of the changeover cam 76 so as to slidabley move along the inner surface of the changeover cam 76 clockwise or counterclockwise.

Figure 7:
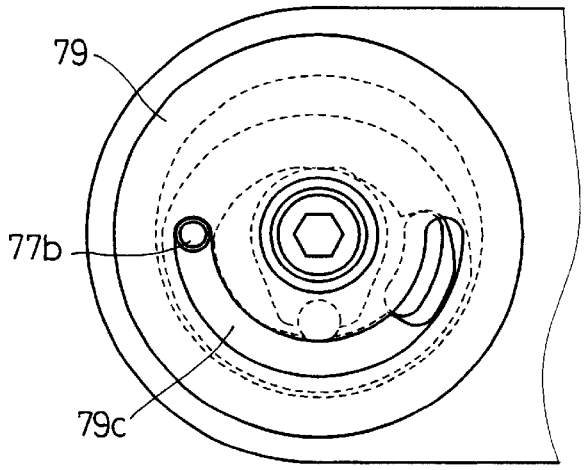
FIG. 7 is a magnified plan view of the head shown in FIG. 3.

The changeover knob 79 has a semi-circular elongated hole 79*c* through which the pivotal pin 77*b* extends, as shown in FIG. 7. When the pivotal pin 77*b* abuts against one of the ends of the elongated hole 79*c*, the changeover cam 76 is held at the position where it has moved clockwise or counterclockwise.

The front part of the hollow handle 1 is turnably connected clockwise and counterclockwise to the rear anchor parts of the upper and lower sandwiching plates 8*a* and 8*b* of the sheath tube 8 with upper and lower screws 12. That is, the hollow handle 1 and the sheath tube 8 are bendably connected to each other by these screws 12.

These screws 12 are disposed along the center line of the turning member 6*a* attached to the rear part of the head 4 at the time when the head 4 has completed its inward turn, that is, at the time when the head 4 has finished its counterclockwise turn after its previous clockwise turn.

The hollow handle 1 has the short cylindrical slider 13 disposed around the middle part thereof so as to be slidable in the back and the forth direction, as shown in FIGS. 1 and 2.

The torque transmitting mechanism 9 is disposed between the front and rear end surfaces of the slider 13 and the sheath tube 8, respectively. The torque adjusting mechanism 10 is disposed around the rear half of the hollow handle 1 which is exposed between the rear and front end surfaces of the slider 13 and the grip 1*a* of the hollow handle 1, respectively.

Figure 8:
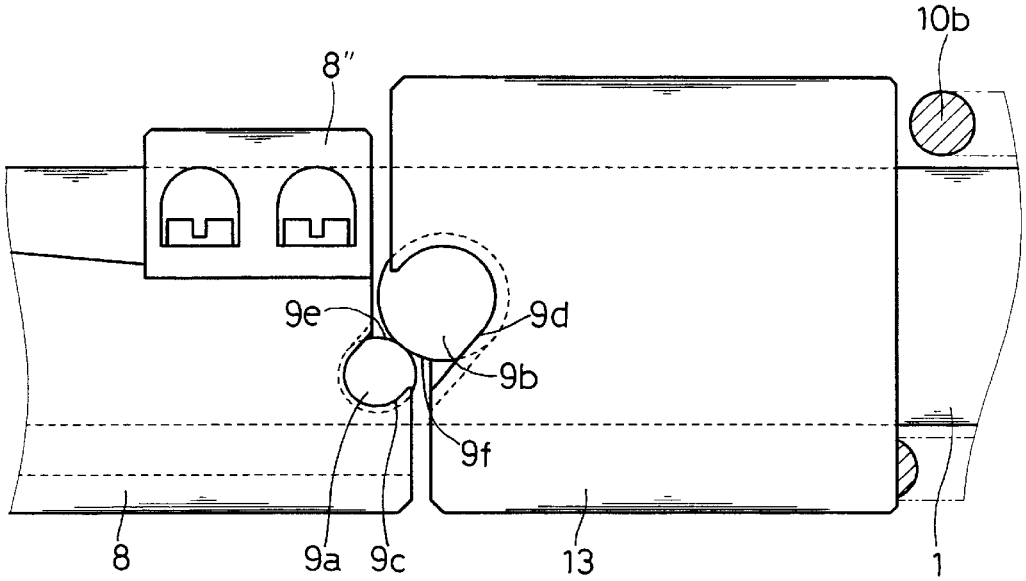
FIG. 8 is a magnified plan view of a torque transmission mechanism shown in FIGS. 1 and 2.
Figure 9:
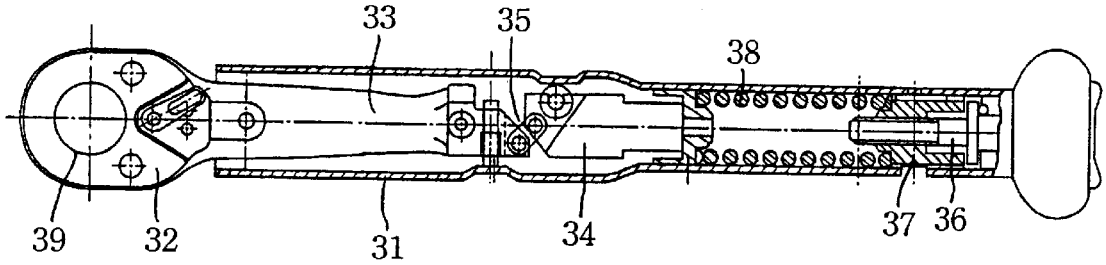
Prior Art FIG. 9
FIG. 9 is a schematic longitudinal plan view in section of a known hand torque wrench.
Figure 10:
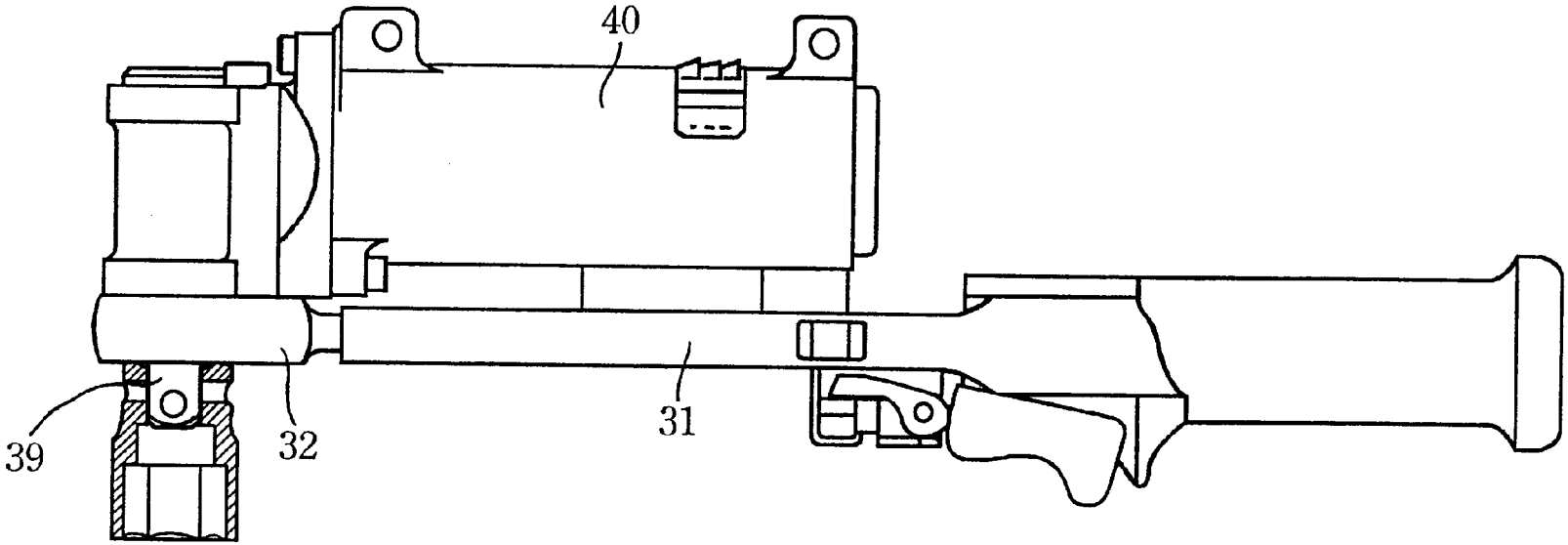
Prior Art FIG. 10
FIG. 10 is a schematic longitudinal side view of a known power torque wrench.

As shown in FIGS. 2 and 8, the torque transmitting mechanism 9 is constructed such that U-shape slanted depressions 9*c*, which are open toward the right direction in the figures, are formed at the upper and lower parts of the rear periphery of the sheath tube 8, and the front halves of first small-diameter disk-shape projections 9*a* are fitted into and supported by the corresponding slanted depressions 9*c*. In addition, U-shape slanted depressions 9*d*, which are open toward the left direction in the figures, are formed at the upper and lower parts of the front periphery of the slider 13 and the rear halves of second disk-shape projections 9*b* having larger diameters than the first projections 9*a* are fitted into and supported by the corresponding slanted depressions 9*d*. Furthermore, a right-side arc-shaped slanted engaging surface 9*e* of each first projection 9*a*, protruding backward from the rear of the sheath tube 8, is disengageably engaged with a left-side arc-shaped slanted engaging surface 9*f* of the corresponding second projection 9*b*, protruding frontward from the front of the slider 13.

As shown in FIG. 2, the torque adjusting mechanism 10 has a male-threaded portion 10*c*, formed around the outer surface of the rear half of the hollow handle 1, an adjusting nut 10*a* screwed together with the rear part of the male-threaded portion 10*c*, and an adjusting coil spring 10*b* disposed in a compressed manner between the mutually opposing end surfaces of the adjusting nut 10*a* and the slider 13.

With this arrangement, the engaging force between the first projections 9*a* and the corresponding second projections 9*b* of the torque transmitting mechanism 9 is changeable such that a spring force of the adjusting coil spring 10*b* which pushes the slider 13 forwards is adjusted in accordance with the advancement of the adjusting nut 10*a*.

Subsequently, an operation of the torque wrench having the above-described structure will be described.

First of all, the socket S is attached to the square shank 3*b* of the output shaft 3. When a screw such as a bolt or a nut engaged with the socket S is to be fastened, the changeover knob 79 of the rotation-direction changeover mechanism 7 is turned counterclockwise. Then, the boss 79*a* is turned together with the changeover knob 79 in the same direction, causing the changeover cam 76 to be turned clockwise up to the position shown in FIG. 5 with the pivotal pin 77*b* as a fulcrum. In accordance with the clockwise turn of the changeover cam 76, each changeover piece 78*a*, which is disposed in a standing manner on the circumferential bottom surface of the turning ring 78 via the locking projection 78*b* of the turning ring 78 and which engages the corresponding engaging hole 76*a*, moves clockwise by a predetermined circular length. Also, in accordance with the movement of the changeover piece 78*a*, the corresponding locking member 74 disposed in the space between the round center hole 4*a* and the corresponding surface 71 of the regular polygonal column of the output shaft 3 is pushed clockwise a little within a moveable region in the space.

In this state, when the valve 25 is released by pushing the operation lever 28, the compressed air is fed from a compressed-air feeder to the guiding path 23 via the compressed-air feeding hole 22 of the compressed-air feeding attachment 21 and causes the air-motor 2 to rotate.

The rotation of the air-motor 2 causes the transmission shaft 5 in the hollow handle 1 to rotate, and thus the crank pin 6*c* protruding from the front of the transmission shaft 5 to rotate about the center of the transmission shaft 5. The rotation of the crank pin 6*c* is transmitted to the head 4 via the turning member 6*a* so that the head 4 turns about the output shaft 3 clockwise and counterclockwise in a reciprocating manner in a predetermined angular range.

When the head 4 turns clockwise starting from the position shown in FIG. 4, the locking members 74 move clockwise while slidably contacting the inner wall of the center hole 4*a* of the head 4. Immediately after the locking members 74 start to move, they engage into the corresponding wedge-shape spaces 72*a* formed ahead of the moving direction. As a result, the locking members 74 combine the head 4 and the output shaft 3 into one unit and thus the turning force of the head 4 is transmitted to the output shaft 3. With this arrangement, the screw engaged with the socket S is turned by the turning angle of the head 4 in the fastening direction of the torque wrench (i.e., clockwise in this case).

When the head 4 turns counterclockwise, the locking members 74 disengage from the corresponding wedge-shape spaces 72*a* into the corresponding moveable regions, received by the corresponding changeover pieces 78*a* in the moveable regions, and thus are prevented from moving further. Accordingly, only the head 4 turns counterclockwise and the screw is neither fastened nor unfastened.

As described above, when the head 4 turns clockwise, the locking members 74 engage into the corresponding wedge-shape spaces 72*a* and accordingly transmit the turning torque of the head 4 to the output shaft 3. When the head 4 turns counterclockwise, the locking members 74 disengage from the corresponding wedge-shape spaces 72*a* and disconnect the coupling between the head 4 and the output shaft 3. Since the head 4 is repeatedly turned clockwise and counterclockwise by the air-motor 2, the screw is quickly fastened to its seating surface.

When the screw is seated on the seating surface, the frictional force between the screw and the seating surface increases and eventually becomes greater than a value corresponding to the torque of the air-motor 2. Since the torque of the air-motor 2 becomes insufficient and accordingly the screw cannot be further fastened until its fastening torque reaches a predetermined value, the air-motor 2 is stopped and the screw is fastened by hand by turning the hollow handle 1 clockwise and counterclockwise.

The front of the hollow handle 1 is connected to the sheath tube 8, which is disposed around the front half of the hollow handle 1, so as to be bendable clockwise and counterclockwise with the upper and lower screws 12 as fulcra. The sheath tube 8 is connected to the head 4 at the front thereof such that the upper and lower sandwiching plates 8*a* and 8*b* at the front of the sheath tube 8 surround the output shaft 3, and is connected to the hollow handle 1 at the rear thereof via the torque transmitting mechanism 9.

With this arrangement, when the hollow handle 1 is turned clockwise and counterclockwise by hand while the grip 1*a* is being held, the turning torque of the hollow handle 1 is transmitted to the sheath tube 8 via the torque transmitting mechanism 9, thereby allowing the sheath tube 8 to turn about the output shaft 3 in a reciprocating manner. Accordingly, the hollow handle 1 also turns in concert with the sheath tube 8 in a reciprocating manner until the fastening torque of the screw reaches a predetermined value, allowing the head 4 to turn, via the crank pin 6*c* protruding from the front of the transmission shaft 5 in the hollow handle 1, clockwise and counterclockwise in a reciprocating manner in the same fashion as described above.

When the head 4 turns about the output shaft 3 clockwise and counterclockwise in a reciprocating manner, by turning the head 4 outwards, that is, clockwise in this case, the locking members 74 engage into the corresponding wedge-shape spaces 72*a* and thus the fastening torque of the head 4 is transmitted to the output shaft 3 so that the screw is fastened in a similar fashion to that as described above. When the head 4 is turned inwards, that is, counterclockwise in this case, since the locking members 74 disengage from the corresponding wedge-shape spaces 72*a*, the turning torque of the head 4 is not transmitted to the output shaft 3. By turning the head 4 clockwise again, the screw can be further fastened.

In the torque transmitting mechanism 9, the right-side arc-shaped slanted engaging surfaces 9*e* of the first projections 9*a* disposed at the upper and lower parts of the rear periphery of the sheath tube 8 are engaged with the corresponding left-side arc-shaped slanted engaging surfaces 9*f* of the second projections 9*b* disposed at the upper and lower parts of the front periphery of the slider 13 which is pushed by the adjusting coil spring 10*b* of the torque adjusting mechanism 10. Accordingly, when the hollow handle 1 is turned clockwise, the turning torque of the hollow handle 1 is transmitted to the sheath tube 8 via the first and second projections 9*a* and 9*b* which are engaged with each other in a mutually compressed manner, thereby allowing the sheath tube 8 to turn in concert with the hollow handle 1 so as to fasten the screw as described above.

The larger the frictional force between the screw and the seating surface, the larger turning torque of the sheath tube 8 is required for turning the screw in its fastening direction. When this increased turning torque reaches a torque corresponding to the engaging force between the first and second projections 9*a* and 9*b*, the screw does not turn in its fastening direction any further and is held with a predetermine fastening torque even when the clockwise turning torque is exerted on the hollow handle 1.

This clockwise turning force exerted on the hollow handle 1 causes the left-side arc-shaped slanted engaging surfaces 9*f* of the second projections 9*b* to slide and climb on the right-side arc-shaped slanted engaging surfaces 9*e* of the corresponding first projections 9*a* close to the sheath tube 8, while causing the second projections 9*b* close to the slider 13 to push the slider 13 rearwards against a predetermined spring force of the torque-adjusting coil spring 10*b*.

At the same time, the hollow handle 1 turns and bends clockwise about the upper and lower screws 12, to which the front of the sheath tube 8 is pivotally mounted, relative to the sheath tube 8, thereby causing the left side surface of the middle part of the hollow handle 1 with respect to the longitudinal direction of the same to hit against the opposing inner surface of the rear part of the sheath tube 8.

When an operator holding the grip 1*a* notices an instantaneous turning movement of the hollow handle 1 or a hitting sound of the hollow handle 1 against the sheath tube 8 at this moment, the operator stops turning of the hollow handle 1. Subsequently, as described above, the screw is fastened by hand until the fastening torque of the screw reaches a predetermined value. In stead of the above arrangement, the completion of fastening the screw may be confirmed by detecting the fact that the second projections 9*b* have climbed over the corresponding first projections 9*a*.

The fastening torque of the screw is set by moving the adjusting nut 10*a* screwed together with the threaded portion 10*c* of the hollow handle 1 frontward or rearward so as to adjust the engaging force between the first and second projections 9*a* and 9*b* produced by the spring force of the adjusting coil spring 10*b*.

When the screw is to be unfastened, the changeover knob 79 of the rotation-direction changeover mechanism 7 is turned clockwise. In accordance with the clockwise turn of the changeover knob 79, the changeover pieces 78*a* cause the corresponding locking members 74 to move counterclockwise within the moveable regions in the spaces formed between the corresponding side surfaces 71 of the output shaft 3 and the round center hole 4*a* of the head 4. The locking members 74 are kept in a received state by the other sides of the corresponding changeover pieces 78*a*.

When the hollow handle 1 is manually turned counterclockwise, the right side surface of the middle part of the hollow handle 1 with respect to the longitudinal direction of the hollow handle 1 abuts against the cover 8" of the sheath tube 8, and thus the sheath tube 8 and head 4 turn in concert with each other in the same direction, thereby allowing the locking members 74 to move counterclockwise while sliding on the inner wall of the center hole 4*a* of the head 4.

At the same time, the locking members 74 engage instantaneously into the corresponding wedge-shape spaces 72*b* disposed ahead of the moving direction and the turning torque of the hollow handle 1 is transmitted from the head 4 to the output shaft 3 via the locking members 74, thereby allowing the screw to turn in its unfastening direction and leading to reduction in the frictional force between the screw and the seating surface.

When the air-motor 2 is activated to rotate, the head 4 turns clockwise and counterclockwise in a reciprocating manner via the crank pin 6*c* protruding from the front of the transmission shaft 5 in the hollow handle 1, and, only when the head 4 turns counterclockwise, the locking members 74 engage into the corresponding wedge-shape spaces 72*b*. With this arrangement, the turning torque of the head 4 is transmitted to the output shaft 3 in the unfastening direction of the screw, allowing the screw to be quickly unfastened.

In the above-describe embodiment, an electric motor may be used as a power source instead of the air-motor 2.

Also, the rotation-direction changeover mechanism 7 may be formed such that the turning torque of the head 4 is transmitted to the output shaft 3 only in the fastening direction of a screw so as to provide a torque wrench for exclusive use in fastening a screw, or alternatively formed by using a ratchet mechanism.

Furthermore, the torque transmitting mechanism 9 may be formed by using the link toggle mechanism described in the Prior Art or the like.

What is claimed is:

1. A torque wrench comprising:

a motor;

an output shaft;

a straight hollow handle for housing the motor therein, the hollow handle having a grip integrally formed at the rear thereof;

a head disposed in front of the hollow handle and rotatably supporting the output shaft in the vertical direction so as to be orthogonal to the longitudinal direction of the hollow handle;

a transmission shaft disposed in the hollow handle;

a rotation-direction changeover mechanism which transmits the rotation of the motor to the output shaft via the transmission shaft;

a sheath tube which covers the front half of the hollow handle with a predetermined gap between the inner surface of the sheath tube and the outer surface of the hollow handle, and which is connected to the head at the front thereof and to the front of the hollow handle;

a slider moveably disposed around the hollow handle in the longitudinal direction of the hollow handle such that the front end surface of the slider opposes the rear end surface of the sheath tube;

a torque transmitting mechanism disposed between the mutually opposing end surfaces of the slider and the sheath tube; and a torque adjusting mechanism disposed in the rear of the slider and around the rear half of the hollow handle.

2. The torque wrench according to claim 1, wherein the rotation-direction changeover mechanism is characterized in that:

the head has a center hole vertically extending therethrough, the output shaft is formed as a regular polygonal column extending in the vertical direction and having side surfaces, and rotatably disposed in the center hole of the head, a space is formed between each side surface of the output shaft and the inner wall of the center hole, and divided into a pair of wedge-shape spaces, each becoming narrower from the center to the corresponding edge of the side surface, a cylindrical locking member is disposed in the middle of the space so as to engage into either one of the wedge-shape spaces on both sides thereof, and a changeover member, which pushes the locking member toward either one of the wedge-shape spaces on both sides thereof, is disposed in a space between the adjacent cylindrical locking members so as to be moveable for changeover in the circumferential direction of the output shaft.

3. The torque wrench according to claim 1, wherein the torque transmitting mechanism comprises a pair of first projections disposed at the upper and lower parts of the rear periphery of the sheath tube and having slanted engaging surfaces protruding toward the rear direction and a pair of second projections disposed at the upper and lower parts of the front periphery of the slider and disengageably engaging the corresponding slanted engaging surfaces of the first projections.

4. The torque wrench according to claim 1, wherein the torque adjusting mechanism comprises an adjusting nut which is screwed together with a male-threaded portion formed on the rear half of the hollow handle and an adjusting coil spring disposed between the mutually opposing end surfaces of the adjusting nut and the slider in a compressed manner.

5. The torque wrench according to claim 3, wherein the torque adjusting mechanism comprises an adjusting nut which is screwed together with a male-threaded portion formed on the rear half of the hollow handle and an adjusting coil spring disposed between the mutually opposing end surfaces of the adjusting nut and the slider in a compressed manner.

* * * * *